US005940043A

United States Patent [19]

Canipe et al.

[11] Patent Number: 5,940,043

[45] Date of Patent: Aug. 17, 1999

[54] UNIDIRECTIONAL FIELD ANTENNA FOR IDENTIFICATION SYSTEM

[75] Inventors: Larry K. Canipe; Gary Mark Shafer, both of Boca Raton, Fla.

[73] Assignee: Sensormatic Electronics Corporation, Boca Raton, Fla.

[21] Appl. No.: 08/804,193

[22] Filed: Feb. 21, 1997

[51] Int. Cl.[6] ..... H01Q 11/12

[52] U.S. Cl. ..... 343/742; 343/895; 343/867; 343/842

[58] Field of Search ..... 343/866, 741, 343/867, 742, 895, 842; 340/551, 572; 11/12; 7/4

[56] References Cited

U.S. PATENT DOCUMENTS

| | | | |
|---|---|---|---|
| 3,151,328 | 9/1964 | Boyer | 343/742 |
| 3,534,372 | 10/1970 | Scheuerecker et al. | 343/742 |
| 4,564,835 | 1/1986 | Dhawan | 340/710 |
| 5,053,774 | 10/1991 | Schuermann et al. | 342/44 |
| 5,321,412 | 6/1994 | Kopp et al. | 343/742 |
| 5,552,649 | 9/1996 | Cowan, Jr. et al. | 310/12 |

*Primary Examiner*—Michael Tokar
*Assistant Examiner*—Daniel D. Chang
*Attorney, Agent, or Firm*—Paul T. Kashimba

[57] ABSTRACT

An antenna system for use in detecting an information tag in an interrogation zone comprising a first coil for generating a first field in an interrogation zone, a second coil that is larger than said first coil and positioned proximate the first coil for generating a second field that opposes the first field, and a nonferrous conductive plate positioned proximate the first and second coils and being shaped so that its periphery is approximately at least as large as the periphery of the second coil.

12 Claims, 1 Drawing Sheet

UNIDIRECTIONAL FIELD ANTENNA FOR IDENTIFICATION SYSTEM

FIELD OF THE INVENTION

This invention relates to identification systems and in particular to antennas utilized in proximity tag readers in such identification systems.

BACKGROUND OF THE INVENTION

Electrically small loop antennas, that is, antennas whose total conductor length is small compared to the associated wavelength in free space, have been used as proximity tag reader antennas in identification systems, such as badge access control systems and asset tracking systems. Normally these proximity tag reader antennas have read range capabilities of approximately five centimeters to twenty centimeters extending both in front of and behind the antenna. The surface on which the card reader antenna is mounted effectively prevents unwanted reading from the back side of the antenna if the wall thickness is greater than the read range of the antenna. A problem arises, however if the read range of the antenna is greater than the thickness of the wall. In this case, an access card could be purposely or accidentally read through the wall from the back side of the antenna thereby defeating the primary purpose of the proximity card reader which is to control the access area and maintain knowledge of the location of the access card. Normally the detection ranges of the antenna have been kept low enough that reading from the back side of the antenna would be limited by the thickness of the mounting surface. For example, normally the read ranges have been reduced to approximately ten to fifteen centimeters for an average wall. If the mounting surface was thinner than the maximum read range, the system or antenna could be de-tuned or de-sensitized intentionally. This would lower the overall read range on the back side of the antenna; however, the read range has to be significantly reduced in installations where the mounting surface is thin such as on a glass wall which is usually only approximately two and a half centimeters thick. Alternatively, the system would have the normal read range but suffer from the undesirable possibility of reading an access badge from the other side of the mounting surface or wall.

Another problem arises if the proximity card reader antenna is mounted on or near a metallic surface. A metallic surface can reduce the read performance of the antenna to an unacceptable level due to the eddy current losses and the de-tuning of the antenna. This de-tuning can, in some cases, be compensated to a limited extent by re-tuning the antenna when it is installed; however, the read range of the re-tuned antenna is inevitably degraded from the original read range capability.

It can be seen that the prior art proximity access card readers have provided a less than satisfactory solution in many installations. In some instances the read range has been decreased to prevent reading from the back side of the card reader antenna. In other instances to increase the read range of the reader antenna the undesirable possibility of reading from the back side of the antenna through the surface on which it has been mounted has been tolerated. In still other installations the performance of the reader has been significantly degraded by the metallic surface on which it is mounted and has resulted in additional expense in the installation because of the need to re-tune the antenna at the installation site. The proximity readers used in asset tracking systems are troubled by the same problems as the proximity access card readers and face the additional challenge that the read range normally must be maximized to ensure detection of the tag associated with the asset.

SUMMARY OF THE INVENTION

In accordance with the present invention there is provided an antenna system for use in detecting an information tag in an interrogation zone. The antenna system comprises a first coil for generating a first field in an interrogation zone, a second coil and a nonferrous conductive plate. The second coil is larger than the first coil, is positioned proximate the first coil, and generates a second field that opposes the first field. The plate is positioned proximate the first and second coils and is shaped so that its periphery is approximately at least as large as the periphery of the second coil.

In a preferred embodiment of the present invention, the first and second coils are loop antennas with the second coil being a passive coil comprising two concentric loops with a crossover connecting the concentric loops. Preferably, the first and second coils are coaxial and coplanar with the second coil positioned around the periphery of the first coil. The second coil is inductively coupled to the first coil and generates a field that opposes the first field.

The present invention provides an extended read range loop antenna and the ability to read a transponder, such as an access card or asset tracking tag, from only a predetermined antenna surface to overcome existing problems. The antenna system of the present invention reads from only one surface of the antenna to ensure that the identification system knows the location of the access card or asset tag. In addition, the directional properties of the antenna system of the present invention overcomes the detrimental de-tuning effects caused by metallic mounting surfaces. This reduces the overall cost of installation since the antenna system can be tuned at the factory and installed on any surface without any further tuning or degradation of performance.

The present invention provides an antenna system that exhibits an extended read range with a unidirectional characteristic. An extended read range of approximately thirty to forty-six centimeters has been attained while still maintaining the desired unidirectional characteristic to ensure that when an access card or asset tracking tag is presented to any face of the antenna it will be read from the preferred direction only.

Other objectives, advantages, and applications of the present invention will be made apparent by the following detailed description of the preferred embodiment of the invention.

DETAILED DESCRIPTION OF PREFERRED EMBODIMENTS

Figure 1:
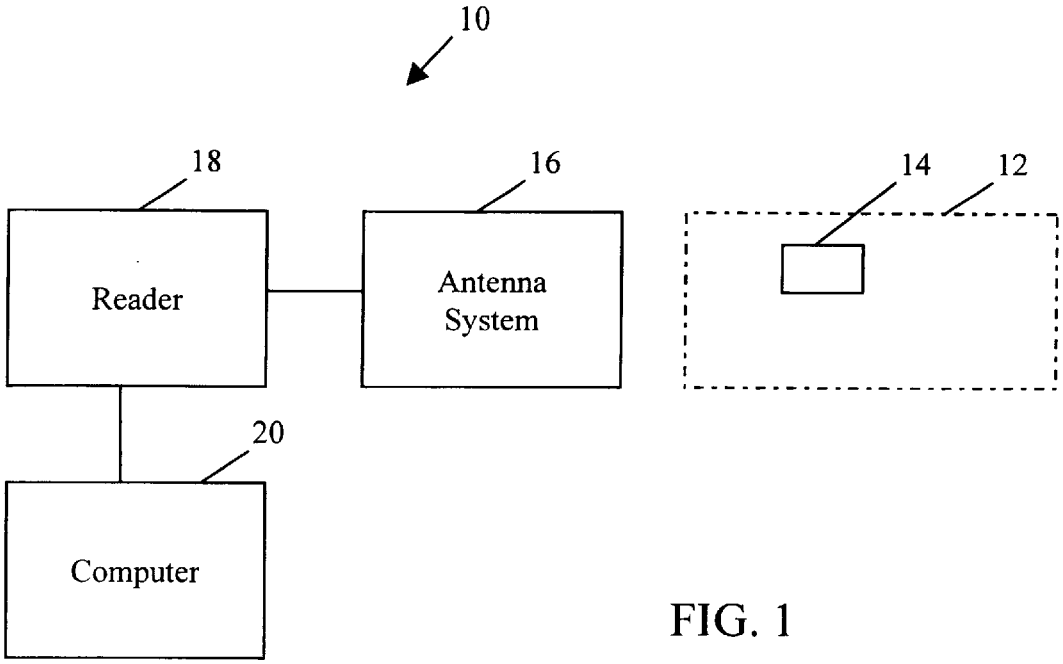
FIG. 1 is a schematic block diagram of the antenna system of the present invention incorporated in an identification system.

The antenna system of the present invention can be utilized with a number of identification systems that are known in the art. A simplified example of one of these systems is shown in FIG. 1. The details of the electronics of one such system are described in U.S. Pat. No. 5,053,774; however, numerous others would be suitable. Referring to FIG. 1, an identification system incorporating the present invention is illustrated generally by numeral 10. A predetermined interrogation zone 12 is the area to be monitored for a radio frequency identification tag or transponder 14 which can be, for example, an access badge or asset identification tag. Identification system 10 consists of antenna system 16 which is used for both transmitting and receiving, reader 18 and computer 20. To interrogate transponder 14, reader 18 sends out a generated field or power burst to transponder 14 via antenna system 16 into interrogation zone 12. In one application the power burst can charge up a passive, for example, battery free, transponder which returns a signal that carries the data that is stored within it. The data signal received by antenna system 16 from transponder 14 is provided to reader 18 for signal processing. Reader 18 then provides the processed data to computer 20 where it is compared with the master security information to determine, for example, if the person possessing the badge should be allowed access. Computer 20 then provides the appropriate signals to door actuation circuitry or alarm circuitry as is know in the art.

Figure 2:
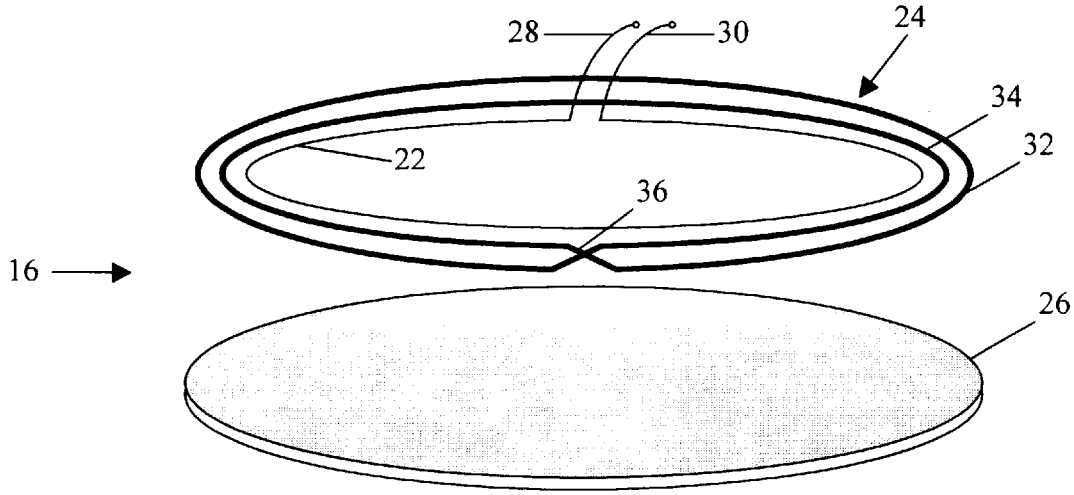
FIG. 2 is a perspective exploded illustrative view of the antenna system of the present invention.

The preferred embodiment of antenna system 16 is shown in detail in FIG. 2. Antenna system 16 has a driven loop antenna 22, which generates the desired field into interrogation zone 14 and also receives the information transmitted by transponder 14. A coupled loop antenna 24 is positioned around the periphery or circumference of drive loop antenna 22 and is located coaxially with driven loop antenna 22 and in the same plane as driven loop antenna 22. Coupled loop antenna 24 has two concentric loops, 32 and 34, with a crossover 36 connecting loops 32 and 34. Crossover 36 can be a piece of insulated wire that is soldered at each end to the ends of concentric loops 32 and 34. A plate 26 is positioned proximate driven loop antenna 22 and coupled loop antenna 24 in a plane that is parallel to the plane that contains driven loop antenna 22 and coupled loop antenna 24. Plate 26 consists of a nonferrous conductive material, such as aluminum, silver, copper, gold or brass, that provides an eddy current shield for the flux from the center of driven loop antenna 22. An opposing current that is 180 degrees out of phase with the drive current provided to driven loop antenna 22 terminals 28 and 30 from reader 18 is induced in coupled loop antenna 24 from the inductive coupling between driven loop antenna 22 and coupled loop antenna 24. Plate 26 in conjunction with coupled loop antenna 24 cancel the flux on the back side of antenna system 16 yet allow sufficient field on the front side. Coupled loop antenna 24 generates a field that cancels the field generated by driven loop antenna 22 around the periphery of antenna system 16, and plate 26 provides an eddy current shield for the flux from the center of driven loop antenna 22.

The distance between plate 26 and the driven loop antenna 22 and coupled loop antenna 24 depends on the application, such as the size of the antennas and material chosen for plate 26, and is determined empirically. The thickness of plate 26 is frequency dependent, and a plate made of aluminum having a thickness of approximately 1.6 millimeters has been found to provide an effective shield in the frequency range above 10 KHz. For example, an aluminum plate of approximately 1.6 millimeters thick provided satisfactory shielding for a driven loop antenna when the plate was located approximately 20 millimeters from the driven loop antenna. The driven loop antenna was a flat copper trace on a printed circuit board having 8 turns, an outside diameter of approximately 12.7 centimeters, width of approximately 0.5 millimeters and thickness of approximately 0.05 millimeters. The wire equivalent of the driven loop antenna was 22 AWG. A satisfactory arrangement for the coupled loop antenna in this embodiment was a flat copper trace on a printed circuit board having an outside diameter of approximately 19 centimeters, width of approximately 7.6 millimeters, and thickness of approximately 0.05 millimeters. The distance from the inside loop of the coupled loop antenna to the driven loop antenna was approximately 10.2 millimeters, and the distance between the two concentric loops of the coupled loop antenna was approximately 7.6 millimeters. The wire equivalent of the coupled loop antenna was 18 AWG.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the foregoing disclosure.

What is claimed is:

1. An antenna system for use in detecting an information tag in an interrogation zone, said antenna system comprising: a first coil for generating a first field in an interrogation zone; a second coil that is passive and is larger than said first coil and positioned proximate said first coil, said second coil being coupled to said first coil such that said second coil generates a second field that cancels the portion of said first field around the periphery of said second coil; and a nonferrous conductive plate positioned proximate said first and second coils and being shaped so that its periphery is approximately at least as large as the periphery of said second coil, said nonferrous conductive plate providing an eddy current shield for the flux from the center of said first coil.

2. An antenna system as recited in claim 1, wherein said second coil comprises two concentric loops with a crossover connecting said two concentric loops.

3. An antenna system as recited in claim 2, wherein said second coil is positioned around the periphery of said first coil.

4. An antenna system as recited in claim 3, wherein said first and second coils are loop antennas.

5. An antenna system as recited in claim 4, wherein said first and second coils are positioned coaxially.

6. An antenna system as recited in claim 5, wherein said first and second coils are coplanar.

7. An antenna system as recited in claim 6, wherein said plate is positioned parallel to said first and second coils.

8. An antenna system as recited in claim 7, wherein said plate is approximately circular.

9. An antenna system as recited in claim 8, wherein said plate consists of aluminum.

10. An antenna system as recited in claim 1, wherein said antenna system only detects an information tag located on the side of the antenna system opposite said plate.

11. An antenna system as recited in claim 2, wherein said antenna system only detects an information tag located on the side of the antenna system opposite said plate.

12. An antenna system as recited in claim 9, wherein said antenna system only detects an information tag located on the side of the antenna system opposite said plate.

* * * * *